United States Patent [19]

Runyon

[11] 4,074,477

[45] Feb. 21, 1978

[54] MODULAR BUILDING STRUCTURE

[76] Inventor: John F. Runyon, 91 Kent St., Apt. 4, St. Paul, Minn. 55102

[21] Appl. No.: 397,765

[22] Filed: Sept. 17, 1973

Related U.S. Application Data

[63] Continuation-in-part of Ser. No. 145,768, May 21, 1971, abandoned.

[51] Int. Cl.[2] ..... E04B 1/32

[52] U.S. Cl. ..... 52/86; 52/646; 52/648

[58] Field of Search ..... 403/53, 54; 52/81, 86, 52/639, 645, 648, 646

[56] References Cited

U.S. PATENT DOCUMENTS

| | | | |
|---|---|---|---|
| 1,336,324 | 4/1920 | Waern | 52/639 |
| 1,506,114 | 8/1924 | Donaggio | 403/53 |
| 3,186,524 | 1/1965 | Spaeth | 52/86 |
| 3,325,958 | 6/1967 | Moore | 52/81 |
| 3,346,998 | 10/1967 | Nelson | 52/574 |
| 3,374,588 | 3/1968 | Alfrey et al. | 52/81 |
| 3,531,851 | 10/1970 | Douglas | 52/86 |
| 3,584,400 | 6/1971 | Voges | 52/DIG. 10 |
| 3,830,031 | 8/1974. | Soisson | 52/648 |

FOREIGN PATENT DOCUMENTS

| | | | |
|---|---|---|---|
| 224,317 | 11/1962 | Austria | 52/80 |
| 405,398 | 11/1909 | France | 52/81 |
| 905,185 | 4/1945 | France | 52/86 |
| 1,170,786 | 11/1969 | United Kingdom | 52/81 |

*Primary Examiner*—James L. Ridgill, Jr.
*Attorney, Agent, or Firm*—Burd, Braddock & Bartz

[57] ABSTRACT

Building structures formed from repeating alternating mirror-image forms of basic mathematically determinate structural modules. The structure is applicable to the construction of buildings without internal supporting pillars or other structural supports which form interior obstructions. Such structures are especially adapted for such uses as auditoriums, concert halls, exhibition halls, field houses, storage buildings, stadium covers, etc. The structures are readily adapted for factory fabrication and partial assembly, shipment as partially assembled components and final on-site assembly. The structural modules are foldable. Structures may be assembled from modules in folded or collapsed condition at or near ground level and then erected by unfolding into structures of substantial length, width and height. The completed structures may take the form of a surface of revolution, such as a hemisphere, toroid, catenoid, etc., cylindrical surface, such as a barrel vault, free-form vault, plane, or various combinations of these forms.

15 Claims, 33 Drawing Figures

INVENTOR.
JOHN F. RUNYON
BY
Burd, Braddock & Bartz
ATTORNEYS

INVENTOR.
JOHN F. RUNYON
BY
Burd, Braddock & Bartz
ATTORNEYS

INVENTOR.
JOHN F. RUNYON
BY
Burd, Braddock & Bartz
ATTORNEYS

INVENTOR.
JOHN F. RUNYON
BY
Burd, Braddock & Bartz
ATTORNEYS

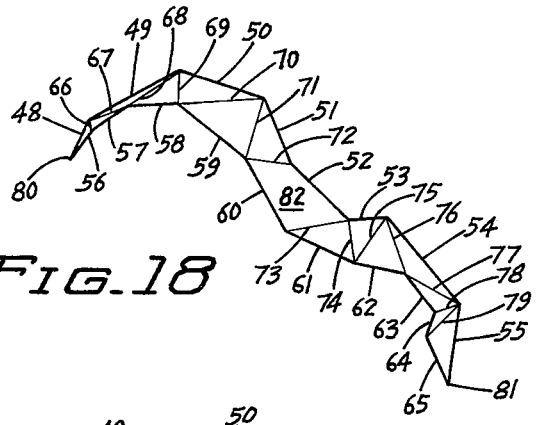
FIG. 18
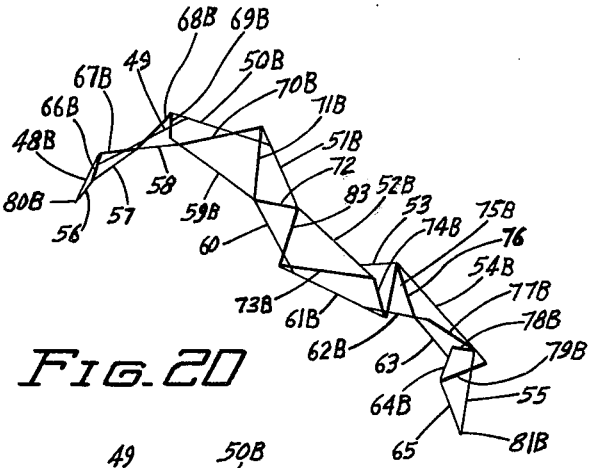
FIG. 20
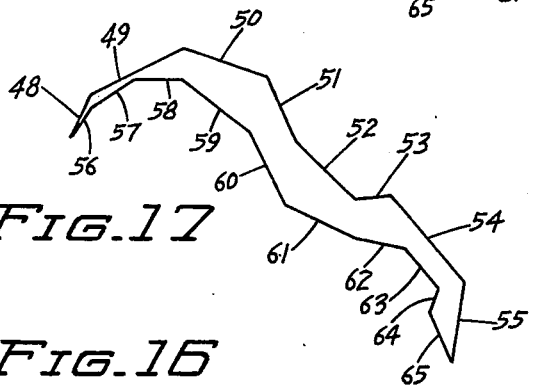
FIG. 17
FIG. 16
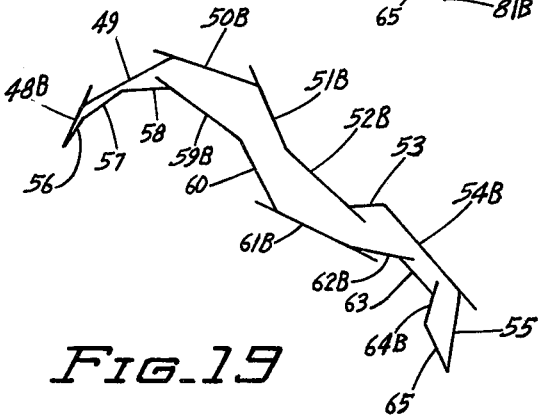
FIG. 19
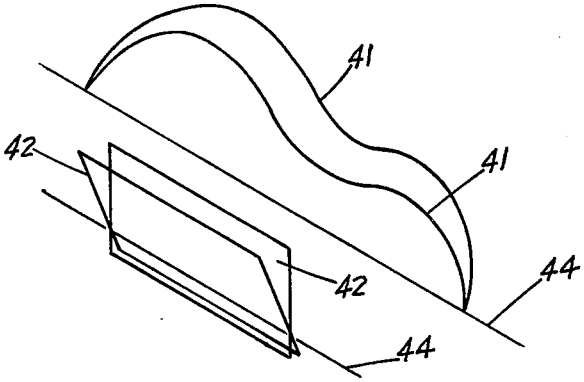
FIG. 16a
INVENTOR.
JOHN F. RUNYON
BY
Burd, Braddock & Barty
ATTORNEYS

INVENTOR.
JOHN F. RUNYON

BY
Burd, Braddock & Barty

ATTORNEYS

MODULAR BUILDING STRUCTURE

This application is a continuation-in-part of my copending application Ser. No. 145,768 filed May 21, 1971, now abandoned.

This invention relates to building structures formed from repeating alternating mirror-image forms of basic mathematically determinate structural modules, i.e., determinate according to the rules of structural analysis. The structure is applicable to the construction of buildings of many types for all purposes, but especially for the construction of buildings without internal supporting pillars or other structural supports which form interior obstructions. Accordingly, structures built according to the present invention are especially adapted for such uses as auditoriums, concert halls, exhibition halls, field houses, storage buildings, stadium covers, and the like. Because the structures are readily adapted for factory fabrication and partial assembly, shipment as partially assembled components and final on-site assembly, the structures are especially adapted for temporary buildings for use at fairs, trade shows, exhibitions, cultural festivals, and the like. Because the structural modules are intended to be foldable, structures may be assembled from modules in folded or collapsed condition at or near ground level and then erected by unfolding into structures of substantial length, width and height. The completed structures may take the form of a surface of revolution, such as a hemisphere, toroid, catenoid, etc., cylindrical surface, such as a barrel vault, free-form vault, plane or various combinations of these forms.

Each structural module is comprised of a plurality of rigid structural components, such as struts or panels or combinations of struts and panels, flexibly connected to adjoining components. An openwork structure composed of modules formed from struts may be used, for example, as the support for an overall protective covering which might be temporary, in the nature of a tent. Or a structure may be permanent, in the nature of panels secured to struts, or sprayed structural foams, sprayed concrete, or the like.

Each structural module may be regarded as being limited by two imaginary planes defining the opposite sides of each module. Each adjacent module is a mirror-image of that lying next to it. For example, in sequence there is a right-handed form, a left-handed form, a right-handed form identical to the first, a left-handed form identical to the second, and so on. Each module lies within the limits of, that is, in the space between a pair of adjacent imaginary planes in a series, each plane displaced equally from the next.

The structural components of the modules are flexibly connected such that any two adjoining components considered by themselves are free to pivot with respect to each other without torque or moment transmitting ability, either as a result of point hinge connection as between the ends of adjoining struts or corners of adjacent panels, or linear hinge connection along a line common to two panels hinged together. Those parts of the components lying in the imaginary planes defining the limits of each module approximate a curve. The parts of the components lying in the imaginary planes are constrained against moving outside of the planes, and any parts of the components forming ends of the module which lie outside of, that is, not touching, the planes (such as at the base of a vault) are constrained to lie at predetermined fixed points in space. Components are connected such that the module forms a mathematically determinate structure when subject to like constraints. In the total structure, each module constrains components of its adjacent modules from moving outside the limit planes. Adjacent modules are flexibly connected. That is, any two adjoining components of adjoining modules, considered by themselves, are connected so that they are free to pivot with respect to each other, just as any two adjoining components within the module.

The invention is illustrated with reference to the accompanying drawings in which corresponding parts are identified by the same numerals and in which.

Figure 5:
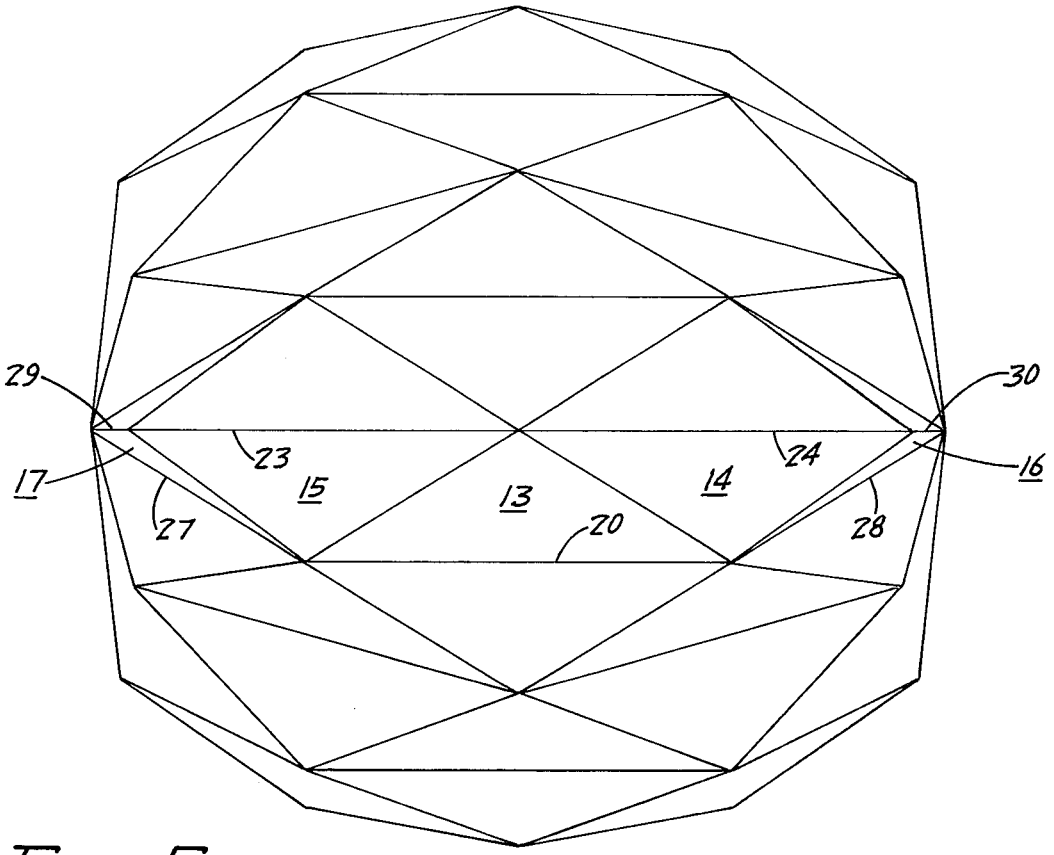
FIG. 5 is a top plan view of such a dome structure.
Figure 4:
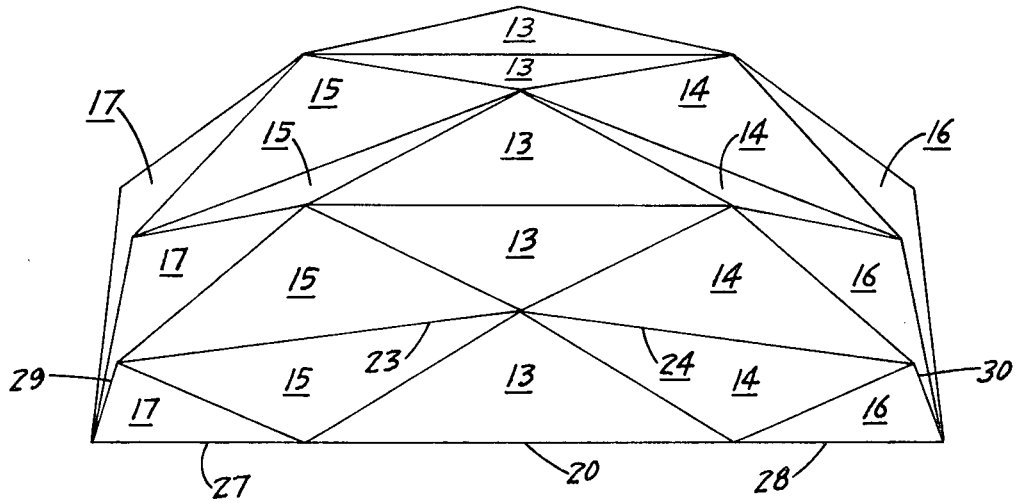
FIG. 4 is an end elevation of a simple form of modular dome structure constructed according to the present invention.
Figure 6:
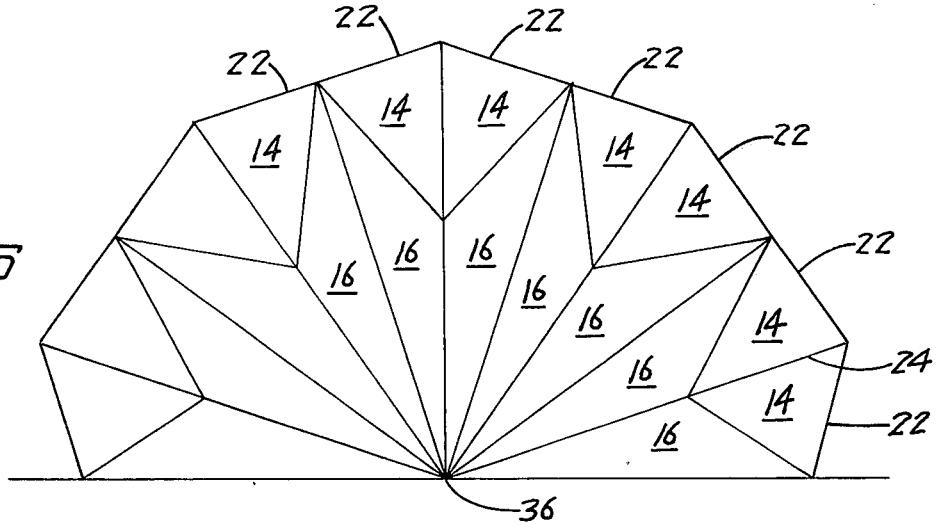
FIG. 6 is a side elevation of a dome, shown fully open.
Figure 7:
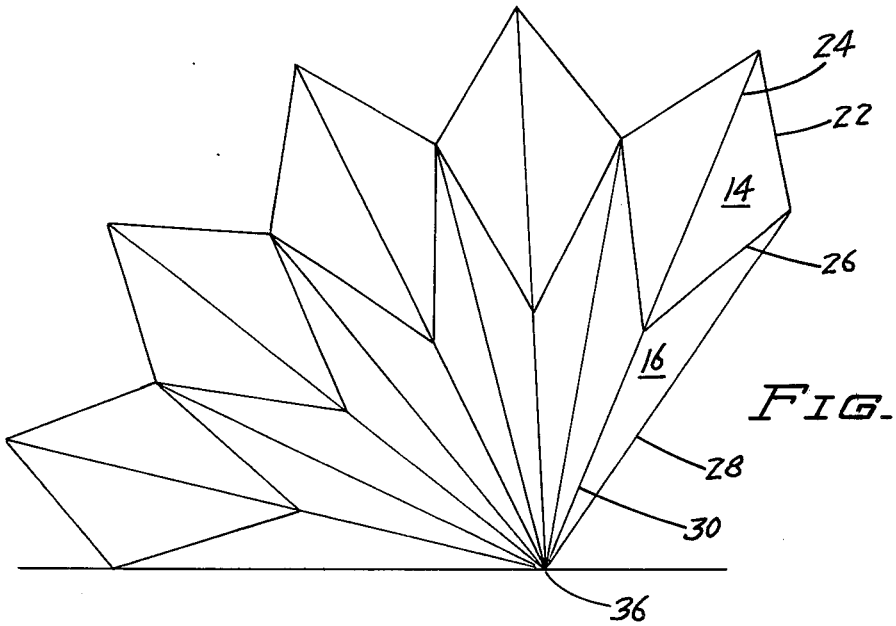
Figure 8:
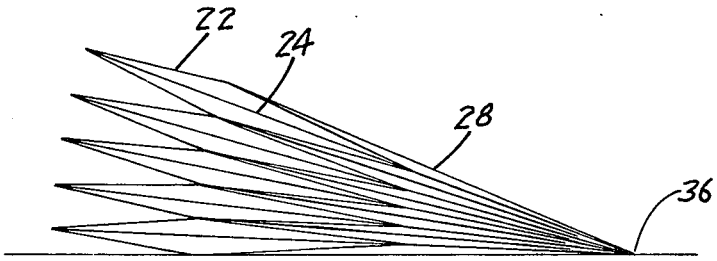
Figure 21:
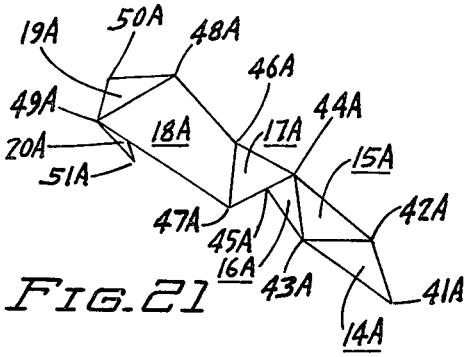
Figure 22:
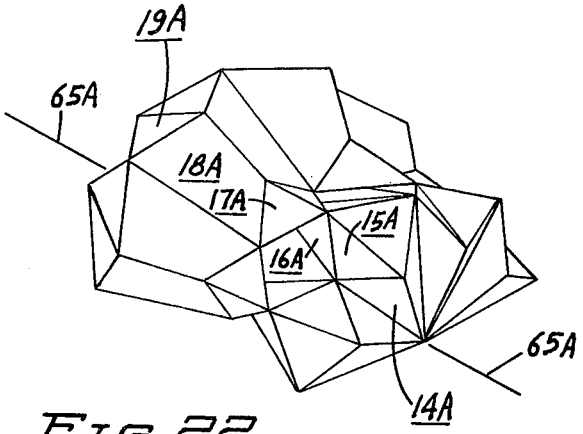
Figure 5A:
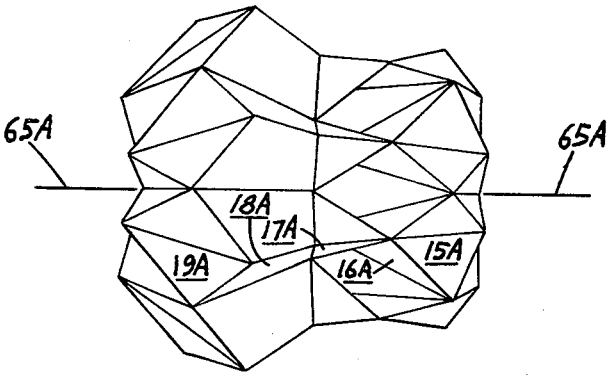
Figure 6A:
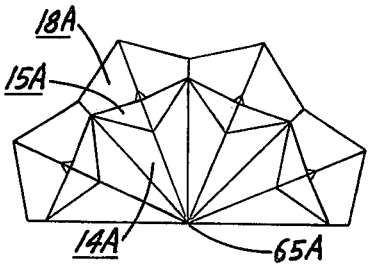
Figure 23:
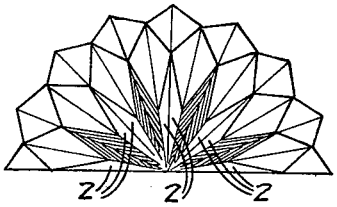
Figure 4A:
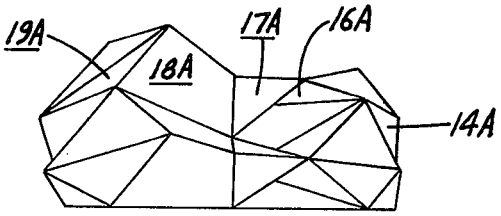
Figure 24:
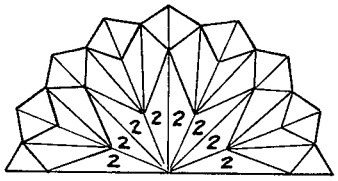
Figure 25:
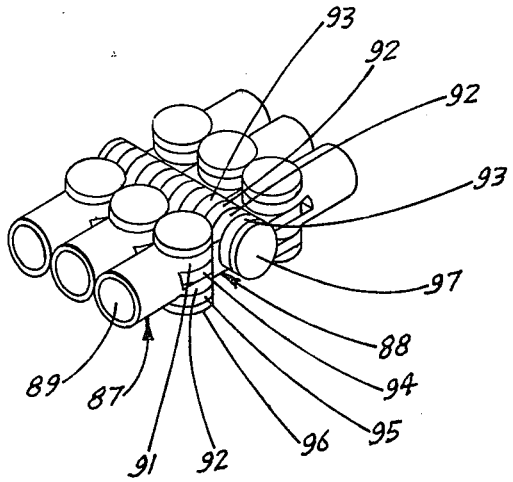
Figure 26:
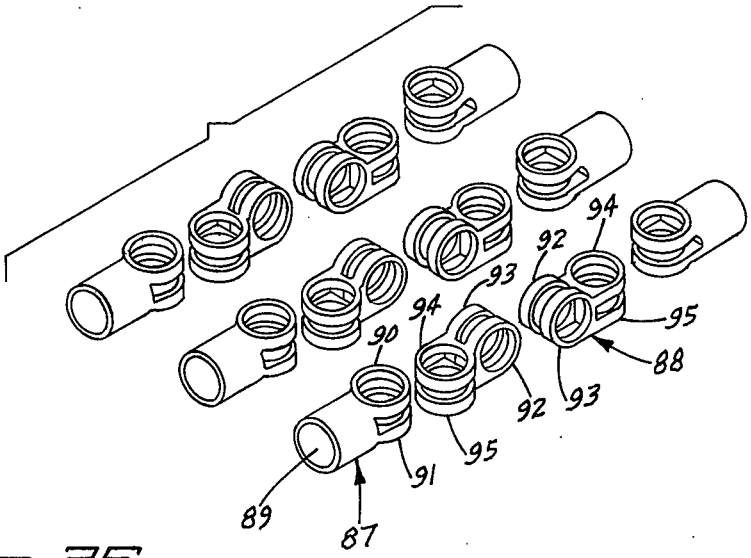

FIGS. 4A, 5A and 6A (on the last sheet of drawings) correspond to FIGS. 4, 5, and 6 showing an alternative form of structure in the shape of a free-form dome;

FIG. 7 is a side elevation of the dome partially collapsed;

FIG. 8 is a similar side elevation showing the dome almost fully collapsed;

FIGS. 9 through 16, 16A and 17 thru 20 are schematic illustrations showing the evolution of formation of modules useful in the construction of structures according to the present invention;

FIG. 21 is a perspective view of one module of the structure in FIGS. 4A, 5A and 6A;

FIG. 22 is a perspective view of a free-form dome structure utilizing the module of FIG. 21;

FIGS. 23 and 24 are end elevations of a further form of dome structure showing how certain structural elements may be eliminated; and FIGS. 25 and 26 show one exemplary form of hinge jont which may be used.

Figure 1:
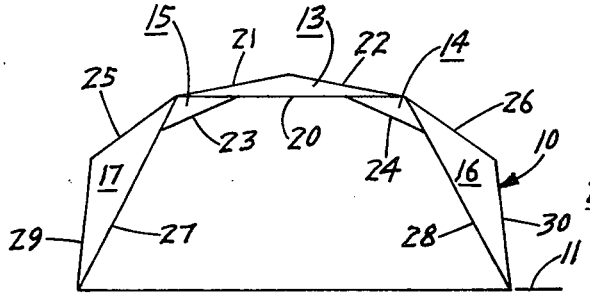
FIG. 1 is an end elevation of a simple form of modular barrel vault structure.
Figure 2:
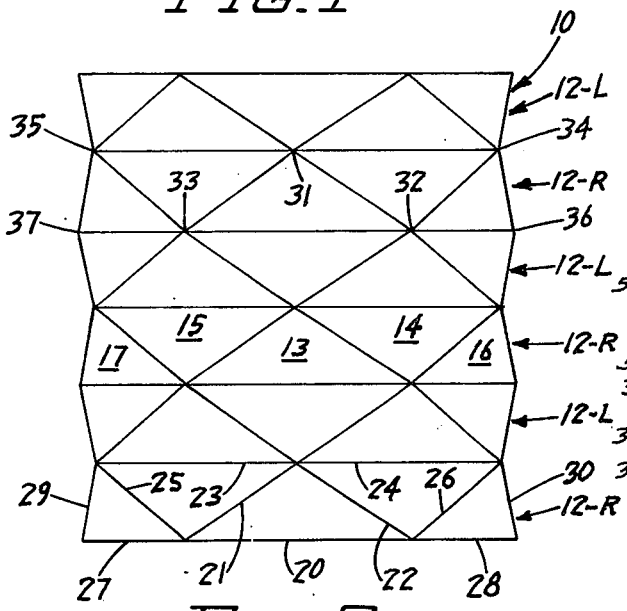
FIG. 2 is a top plan view of such a barrel vault structure.
Figure 3:
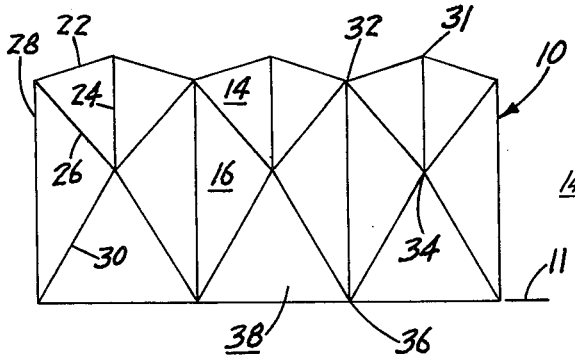
FIG. 3 is a side elevation of a vault structure.

Referring now to the drawings, and particularly to FIGS. 1 through 3, there is shown a form of simple semi-cylindrical barrel vault structure composed of repeating modules. The barrel vault structure, indicated generally at 10, is shown resting on the ground line 11 and is composed of a plurality of alternating modules 12-R and 12-L in repeating pattern. As is apparent, each module 12-R is a mirror-image of the adjoining modules 12-L.

Each module 12-R includes a plurality of components, in this instance triangular components 13–17. In this symmetrical structure components 14 and 15 are identical and components 16 and 17 are identical. The corresponding components of the alternating modules are identical except that they are mirror-images of one another. Each component 13–17 is rigid. It may be in the form of a rigid panel, or it may be a rigid structure formed from struts either open in the area within the struts or closed with appropriate sheet material supported by the struts, or it may be formed in part from struts and in part from panels.

Where the components are formed from struts, component 13 is defined by element 20 which is held in common by component 13 of two adjacent modules; element 21 which is held in common by components 13 and 15 of the same module; and element 22 which is held in common by components 13 and 14 of the same module. Component 14 is further defined by element 24 held in common with component 14 of the next adjacent module and element 26 held in common with component 16 of the same module. Similarly, component 15 is defined by element 25 held in common with element 15 of the next adjacent module and element 25 held in common with component 17 of the same module. Component 16 is further defined by element 28 held in common with component 16 of the next adjacent module and element 30. Component 17 is similarly further defined by element 27 held in common with component 17 of the next adjacent module and element 29.

Where the components 13-17 are formed from struts, each strut is flexibly hinged to each of its immediately adjacent struts. For example, at apex joint 31 two each of struts 21 and 22 of two adjacent modules and struts 23 and 24 held in common by those two modules (six in all) come together at a center point and are hinged to each other. Similarly, at joint 32 each of struts 22 and 26 of adjacent modules and struts 20 and 28 held in common between those modules come together and are flexibly connected. At joint 34 two each of struts 26 and 30 of adjacent modules and strut 24 held in common between those modules come together and are flexibly connected.

When the components 13-17 are solid panels, the common edges between adjacent panels are connected by hinges. Thus panels 13 of adjoining modules are hinged together along edge 20, panels 13 and 14 of the same module are hinged together along common edge 22, etc. Where the modules are composed in part of panels and in part of struts, adjacent panels are hinged along their common edges and hinged at the points of contact with struts. For example, if components 13, 16 and 17 are open and panels 14 and 15 are formed of solid panels, panels 14 and 15 are hinged along their common edges 23 and 24, respectively, and the corners of those panels are flexibly connected to the ends of struts 20, 27, 28, 29 and 30.

The result of these flexible connections is that, if any two adjacent components 13–17 are removed from the remainder of the module while retaining their mutual flexible connection, they are free to pivot with respect to each other either at the linear connection along their adjacent common edges or at a point connection at the point of contact if they meet at only one point. The linear connection allows two adjoining components to pivot about one axis corresponding to the vertex of the dihedral angle they form giving one degree of freedom. The point connections, however, allow adjoining components to pivot with respect to each other about three mutually perpendicular axes given three degrees of freedom.

The adjacent modules 12-R and 12-L are separated by equally spaced apart parallel imaginary planes. The edges 20, 28 and 27 of components 13, 16 and 17, respectively, lie in one plane limiting one side of the module and edges 24 and 23 of components 14 and 15, respectively, lie in the plane defining the other side of the module. Connections 36 and 37 between components 16 and 17, respectively, and the ground level 11 are fixed in their spaced relationship to each other. If the constraint offered by connections 36 and 37 is removed, the structure is collapsible or foldable in the nature of an accordion. If the endmost plane of one of the two endmost modules is maintained stationary while the structure is being collapsed, the imaginary planes remain spaced apart and parallel, the planes remaining equally spaced apart as the spacing is diminished. As the spacing between the imaginary planes decrease, the structure is collapsed and the modules fold upon one another and upon themselves, and in this structure distance between the ground touching tips of components 16 and 17 decreases.

Instead of being collapsed by folding, this structure may also be collapsed by unfolding to lie flat on the ground. These capabilities permit considerable versatility in the assembly and erection of structures. For example, where feasible, a structure may be fully assembled in a factory, shipped to the site assembled and collapsed and then erected by unfolding. Alternatively, the structure might be shipped in the form of component parts, assembled flat at the site and erected by partially folding into the form of the desired structure. More likely, if the components 13–17 are in the form of panels, individual modules are preassembled, shipped flat, and connected at the site. Where the components 13–17 are formed from struts, alternate modules 12-R or 12-L may be preassembled, shipped flat along with the unassembled components 21, 22, 25, 26, 29 and 30. At the erection site, these unassembled components are connected between adjacent assembled modules to complete the structure for erection. In the erected structure, spaces 38–39 between the edges of components 16 and 17, respectively, of adjacent modules and the ground level may be closed with a panel or sheet material of appropriate size and shape and rigidity compatible with the use for which the structure is intended.

Referring now to FIGS. 1A through 3A, there is shown a free-form vault structure composed of repeating modules according to the present invention. The free-form vault structure, indicated generally at 10A, is shown resting on the ground line 11 and is composed of a plurality of alternating modules 12A–R and 12A–L in repeating pattern. As is apparent, each module 12A–R is a mirror-image of the adjoining modules 12A–L.

Each module 12A–R includes a plurality of components which may be considered as rigid panels, in this instance components 13A–21A. The corresponding components of the alternating modules are identical except that they are mirror-images of one another. Each component 13A–17A and 19A–21A may be in the form of a rigid panel, or it may be a rigid structure formed from struts either open in the area within the struts or closed with appropriate sheet material supported by the struts. Component 18A must be formed of a panel rather than four struts.

Where the components are formed from struts, component 15A is defined by element 28A which is held in common by component 15A of two adjacent modules; element 27A which is held in common by components 14A and 15A of the same module; and element 29A which is held in common by components 15A and 16A of the same module. Component 14A is further defined by element 26A held in common with component 14A of the next adjacent module and element 25A held in common with component 13A' of the same module. Component 16A is further defined by element 30A and by that part of element 31A held in common with component 17A of the same module. In this particular structure the area identified by numeral 60A is open, even if all components 13A–21A are panels.

Where the components 13A–17A and 19A–21A are formed from struts, each strut is flexibly hinged to each of its immediately adjacent struts. For example, at apex joint 44A struts 29A and 31A of two adjacent modules and struts 28A and 32A held in common by those two modules (six in all) come together at a center point and are hinged to each other. At joint 43A two each of struts 27A, 29A and 30A of adjacent modules and strut 26A held in common between modules 14A come together and are flexibly connected. At joint 41A two each of struts 23A and 25A of adjacent modules and strut 26A held in common between those modules come together and are flexibly connected. At joint 45A strut 30A is flexibly connected to the middle of strut 31A of the same module. At joint 47A two struts 31A of adjacent modules are flexibly connected to one end of edge 57A hinging two panels 18A of adjacent modules.

When the components 13A–21A are solid panels, the common edges between adjacent panels are hinged. Thus panels 18A of adjoining modules are hinged together along edges 56A and 57A, panels 16A and 17A of the same module are hinged together along part of edge 31A, etc. Where the modules are composed in part of panels and in part of struts, adjacent panels are hinged along their common edges and hinged at the points of contact with struts. For example, if components 16A, 19A and 20A are open and components 17A and 18A are formed of solid panels, panels 17A and 18A are hinged along their common edges 32A, 55A, 56A and 57A, respectively, and the corners of those panels are flexibly connected to the ends of struts 28A, 29A, 33A, 34A and 35A while strut 30A is connected to the middle of edge 31A of panel 17A.

The result of these flexible connections is that, if any two adjacent panels 13A–21A or stuts 23A–38A are removed from the remainder of the module while retaining their mutual flexible connection, they are free to pivot with respect to each other either at the linear connection along their adjacent common edges or at a point connection at the point of contact if they are connected at only one point. The linear connection allows two adjoining panels to pivot about one axis corresponding to the vertex of the dihedral angle they form, giving one degree of freedom. The point connections, however, allow adjoining struts, struts and panels, or panels to pivot with respect to each other about three mutually perpendicular axes giving three degrees of freedom. For example, if component 15A is a panel while components 14A and 16A are open, joint 43A allows component 15A of two adjacent modules to pivot with respect to each other about three mutually perpendicular axes.

The adjacent modules 12A–R and 12A–L are separated by equally spaced apart parallel imaginary planes. The edges 26A, 57A and 35A of components 14A, 18A and 20A, respectively, lie in one plane limiting one side of the module and edges 24A, 28A, 32A, 56A, 33A and 37A of components 13A, 15A, 17A, 18A, 19A and 21A, respectively, lie in the plane defining the other side of the module. The structure is rigid because edges 23A and 38A of components 13A and 21A, respectively, are constrained to fixed positions and because the endmost edges of the two endmost modules are constrained to lie in fixed vertical planes. If these constraints are removed, the structure is collapsible or foldable in the nature of an accordian. If the endmost plane of one of the two endmost modules is maintained stationary while the structure is being collapsed, the imaginary planes remain spaced apart and parallel, the planes remaining equally spaced apart as the spacing is diminished. As the spacing between the imaginary planes decrease the structure is collapsed and the modules fold upon one another and upon themselves, and in this structure the distance between the ground touching edges of components 13A and 21A decreases.

As in the case of the barrel vault structure of FIGS. 1 to 3, these folding capabilities permit considerable versatility in the assembly and erection of structures. For example, where feasible, a structure may be fully assembled in a factory, shipped to the site assembled an collapsed, and then erected by unfolding. Alternatively, the structure might be shipped in the form of component parts, assembled folded at the site and then erected by unfolding into the form of the desired structure. More likely, if the components 13A-21A are in the form of panels, individual modules are preassembled, shiped flat, and connected at the site.

Referring now to FIGS. 4 through 8, there is shown a modular collapsible dome structure formed generally from the same alternating mirror-image modules 12-R, 12-L, as best seen in FIG. 5, but in which the imaginary limiting planes intersect in a common axis of rotation, indicated at 36 in FIGS. 6 through 8. Each module is formed from the same components 13–17 as in the barrel vault structure of FIGS. 1 through 3, the principal difference being that of the angular relationships of each component to its adjoining components. The dome structure is composed of a total of ten modules disposed about the axis of rotation at 36. The modules are generally wedge shaped. Referring to FIG. 5, the elements 30, 24, 23 and 29 approximate a curve and are constrained to lie in one of the imaginary planes defining the wedge, and elements 28, 20 and 27 form a different approximation and are constrained to lie in the next adjacent imaginary plane defining the other side of the wedge. Each plane is spaced equally from the next adjacent plane, that is, the angles of intersection of the planes along the common axis of rotation are equal.

A dome structure as illustrated may be collapsed, as seen by comparison of FIGS. 6 through 8, by folding the structure by rotation about the axis at 36. It will be seen that the wedges defined by the imaginary planes remain equal while diminishing in thickness. As in the case of the barrel vault structure, the dome structure may be preassembled, shipped in folded and collapsed condition and erected by unfolding at the selected site. Or, individual modules may be preassembled, shipped flat and connected to other modules at the selected site for erection. All modules are constrained at their points of common connection spaced apart at opposite ends of the axis of rotation at 36.

Figure 1A:
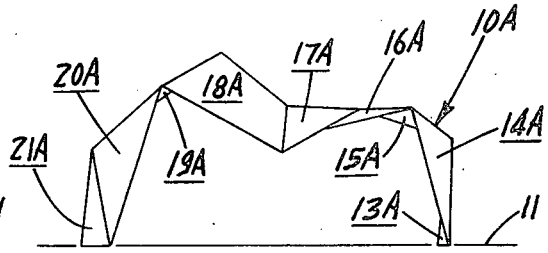
FIGS. 1A, 2A and 3A are corresponding views of an alternative form of structure in the shape of a free-form vault.
Figure 2A:
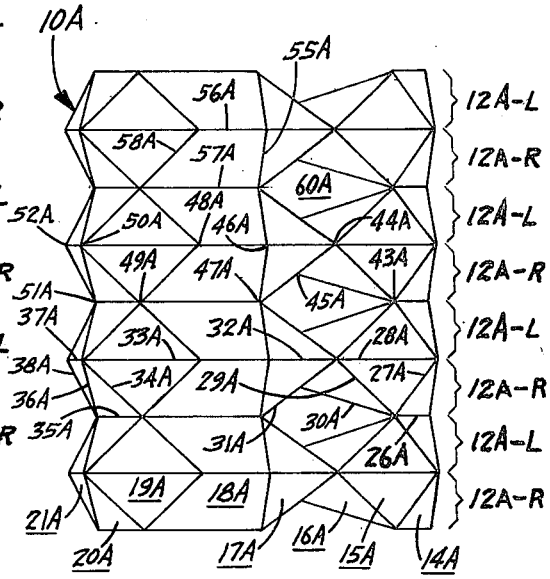
Figure 3A:
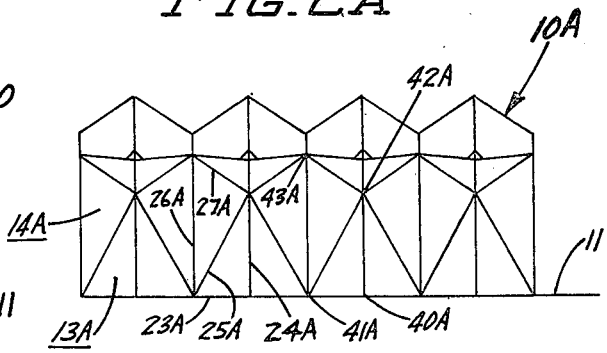

Referring now to FIGS. 4A through 6A, there is shown a modular collapsible free-form dome structure formed generally from th same alternating mirror-image modules 12A–R, 12A–L, etc., of FIGS. 1A, 2A and 3A, as best sseen in FIG. 5A, but in which the imaginary limiting planes intersect in a common axis of rotation, indicated at 65A. Each module is formed from the same components 14A-20A as in the free-form vault structure of FIGS. 1A through 3A, the principal difference being that of the angular relationships of each module to its adjoining modules. This relationship is achieved by eliminating components 13A and 21A of the previous structure and making common, edges 25A of components 14A of adjacent modules, and edges 36A of components 20A of adjacent modules, of the previous structure. Note that the eliminated components (13A and 21A) were adjacent to what is now the axis of revolution of this structure. The process of judiciously eliminating components near the axis of revolution may be repeated more than once, as will be explained.

In Nelson U.S. Pat. No. 3,346,998 granted Oct. 17, 1967, there are shown structures superficially resembling those of the present invention but formed exclusively of flat paneled right triangular building components. The buildings, according to that patent, are constructed alternatively from equal right triangular panels or two unequal right triangular panels, the hypotenuse of the smaller of which is equal in length to the long side of the larger of the two. The components are joined together soley in linear connections allowing pivotal movement with one degree of freedom. The structures are symmetrical in every instance. The differences in concept between the structures of the present invention and those of the prior art are better understood by reference to FIGS. 9 through 20.

Figure 9:
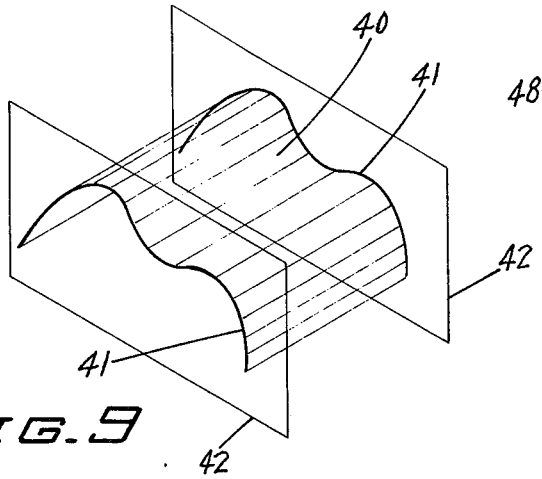
Figure 11:
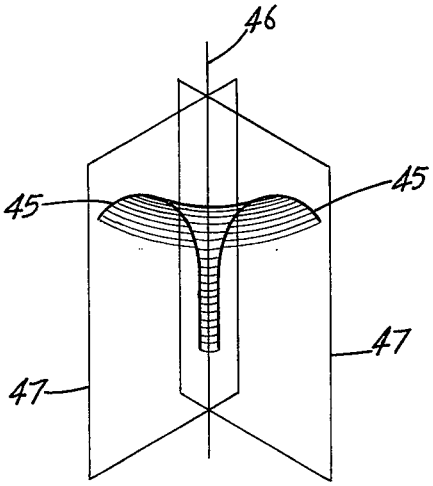

The general principle curve governs the geometry of structures, according to the present invention, may be described as follows. First, a curve is chosen which must be able to be drawn in a plane. It must be possible to sweep out the surface which is desired to be approximated by either translation or rotation of the curve. As seen in FIG. 9, if the desired surface 40 is a right cylindrical surface, the curve 41 is translated in a direction perpendicular to its plane 42 to form a kind of vault. If the desired surface is a surface of revolution 43 then the cure 41 is rotated about an axis 44 which lies in the plane 42 of the curve and which intersects at most only the ends of the curve 41. Alternatively, as seen in FIG. 11, a curve 45 is rotated about a vertical axis 46 which lies in the plane 47 of the curve but does not intersect the curve, or the axis may intersect only one end of the curve.

Figure 12:
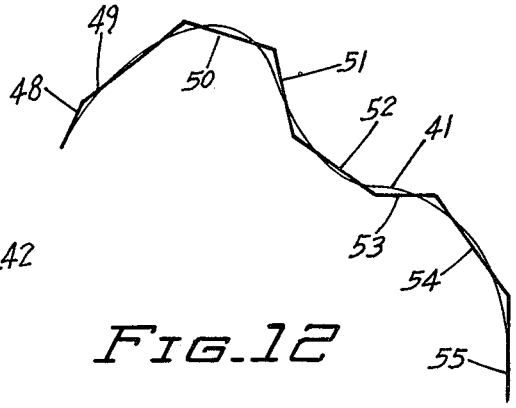
Figure 13:
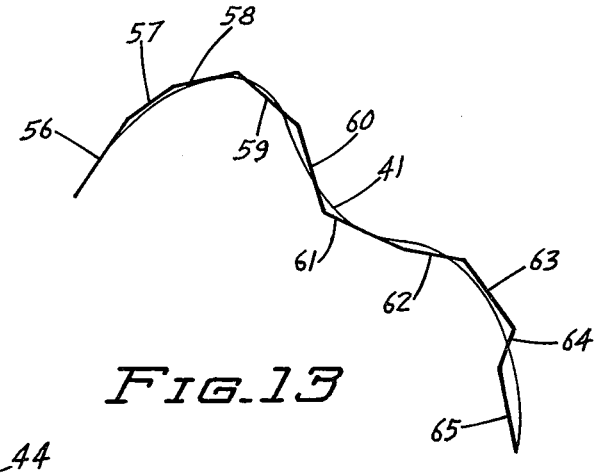
Figure 10:
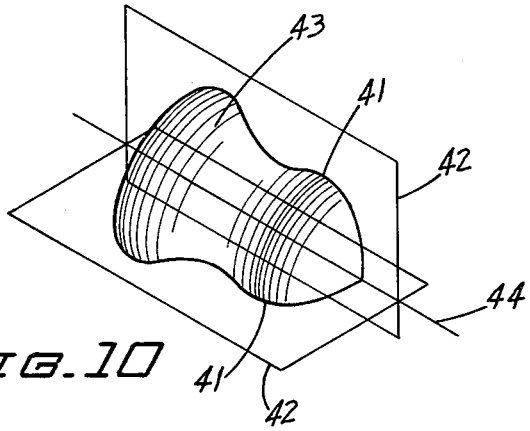
Figure 14:
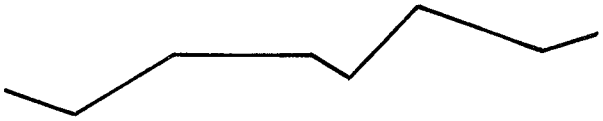
Figure 15:
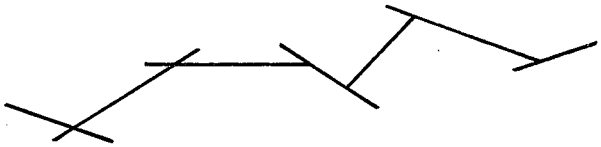

Secondly, a series of points in the plane of the curve are chosen to lie close to or on the curve and to represent the point vertices of the structure which will lie in one half of the previously mentioned set of imaginary planes (alternating every other plane in the set). A second series of points is similarly chosen to represent the piont vertices of the structure which will lie in the other half of the set of planes. Straight line segments serially connecting either of these two series of points would form a rough approximation of the curve. In practice a simpler structure will be formed by choosing members at the planes to have axes (for struts) or edges (for panels) which form such series of line segments, as shown by FIGS. 12 and 13. FIG. 14 shows a series of line segments. FIG. 15 shows a second series based upon the first, in which all line segments meet at points positioned the same as the first, but in which most of the line segments have been extended. Either of these series of line segments, as well as a "series" in which some of the line segments are missing, can be contained in the module limit planes of a structure according to the present invention. In all cases the points that such a series of line segments would connect lie along the curve which sweeps out the idealized surface of the structure.

Thirdly, two planes each containing one of the two series of points are placed a given distance apart along the path the curve must travel to generate the desired surface. For a cylindrical surface, this distance is a small increment of the total linear distance through which the curve is translated. For a surface of revolution, as illustrated, this distance is a small increment (15° for example) of the total angular distance through which the curve is rotated. In either case the size of the increment is arbitrary. FIG. 16 shows the basic curve 41 rotated about the axis 44 through a small increment. FIG. 16A shows the similar relationship of the imaginary planes. FIGS. 17–20 show the development of a strut truss structure. FIG. 17 shows two linear approximations of the curve lying in the same relative displaced positions, all of the linear segments of one approximation lying in one plane and all of those of the other approximation lying in the other plane.

Fourthly; the two approximations of the curve are connected. To reduce the number of components in a module, and to simplify the folding of the structure, it is best to bridge directly between the two planes. That is, each of the plane figures or line segments (representing panels or struts) connection from one plane to the other, spans entirely the distance between the two planes. The connections are made such that the module is structurally determinate when the following constraints are imposed;

1. All parts of the module lying in the imaginary planes are constrained from moving outside the planes, but may slide in the planes, 2. All parts of the module forming ends of the module but outside the imaginary planes (such as at the base of a vault) are constrained to fixed points in space.

The linear segments of two different approximations of the same basic curve are shown in FIG. 17. In FIG. 18 they are shown connected with additional line segments 66-79. If, for example, line segments 52 and 60 are parallel so that segments 52, 60, 72 and 73 may be replaced by panel 82 containing them as edges, and all other line segments are replaced by struts, with the struts of each of the two approximations of the curve constrained to lie in their respective two fixed planes, and with the two end points of each approximation constrained to lie at two fixed points in the planes the structure so formed is structurally determinate.

This structure is determinate when the constraints imposed upon the plurality of struts by the fixed position of the two planes, the four end points and the connections between the struts exactly balance the total degrees of freedom for all joints in the structure. This balance would still be maintained if panel 82 were replaced by five struts (four at the edges and the fifth across one diagonal). In the structure illustrated, the end points 80 and 81 represent two end points each. If the planes are spaced apart and parallel, these four end points are then separated.

In the manner in which any segments of the structure are connected, the joints resist tension and they resist compression but they do not resist pivoting. The freedom of movement, measured by the number of degrees of freedom, of each strut is limited by the fact that the strut must remain connected to other struts at the particular places occupied by connecting joints. Individual struts may pivot around the joint but cannot be pulled out of the point. In other words, rotational degrees of freedom are not constrained by the joints, and thus the joints do not resist moments. For example, a network of flexibly connected struts, as shown in FIG. 18, can be crumpled into any of a number of different positions because such a network has more degrees of freedom than it has constraints.

This structure can be made rigid by providing constraints through the addition of more struts to tie together the already exisiting struts or by limiting the path of travel of a joint, as the structure tries to collapse, to one or two directions, or simply by fixing the joint to occupy one particular location in space. The structure shown in FIG. 18 is rigid because in addition to the connections of the struts, the struts represented by linear segments 48-65 have been constrained to lie in their respective fixed planes.

Struts represented by line segments 48–55 and 56–65 are free to move, but they must move only in their respective planes. All of the constraints, as shown in FIG. 18, exactly balance the total number of degrees of freedom of the joints in the structure. A structure with this balance between degrees of freedom and constraints is structurally determinate. The structure of FIG. 18 forms one module which when repeated in alternating mirror-images forms a dome structure of the nature of those previously described but whose overall surface profile approximates that of curve 41.

As seen in FIGS. 17 through 20, there are many ways in which members can be connected to satisfy the conditions of balance between constraints and degrees of freedom to provide a structure of approximately the same surface. In FIG. 19, there are shown two different straight line approximations of curve 41 similar to those of FIG. 17 except that the straight line segments, while serially connected, are not necessarily connected in end to end relation. As seen in FIG. 20, the struts represented by line segments 48B–55 lying in one plane and 56–65 lying in the other plane are interconnected by constraining struts 66B–79B and 83. Of these, only the struts represented by lines 72 and 76 extend from one joint connection to another, as in FIG. 18. All of the joints are constrained but the struts are not joined in all the same places as in FIG. 18. However, the same conditions of balance between constraints and degrees of freedom exist, and in all cases there are no moment constraints. The suffix "B" in FIG. 20 indicates a line segment which is slightly different from the one shown in FIG. 17. Line 83 has been added to allow panel 82 to be replaced by five struts.

The module structure shown in FIG. 18 may be regarded as a structure composed entirely of flexibly connected panels or as a combination of struts and panels. It cannot be composed entirely of struts. The module structure of FIG. 20, on the other hand, may be regarded as composed entirely of struts or as a combination of struts and panels. It cannot be composed entirely of panels.

FIG. 21 is a perspective view of one of the eight modules of the structure shown in FIGS. 4A, 5A and 6A. FIG. 22 is a view from the same perspective showing the entire structure.

The dome structure illustrated in FIG. 22 is composed of a total of eight modules disposed about the axis of rotation 65A. The modules occupy similar wedge shaped spaces. The points 41A, 42A, 44A, 46A, 48A, 50A and 51A are constrained to lie in one of the imaginary planes defining the wedge, and points 41A, 43A, 47A, 49A and 51A are constrained to lie in the next adjacent imaginary plane defining the other side of the wedge. Each plane is spaced equally from the next adjacent plane, that is, the angles of intersection of th planes about the common axis of rotation 65A are equal.

A free-form dome structure as illustrated may be collapsed in the same manner as that of FIGS. 6 to 8, by folding the structure by rotation about the axis 65A. The wedges defined by the imaginary planes remain equal while diminishing in thickness. As in the case of the symmetrical dome structure, the free-form dome structure may be preassembled, shipped in folded and collapsed condition and erected by unfolding at the selected site. Or, individual modules may be preassembled, shipped flat and connected to other modules at the selected site for erection.

As was mentioned previously, the process of judiciously removing components near the axis may be repeated more than once. Each region of the structure near the axis (a pole or other location where the structure "dips" toward its axis, or more precisely, the regions near relative minima, with respect to the axis, of the curve which generates the surface approximated by the structure) may be assigned a distance from the axis within which the components of the two modules left and right of every fourth limit plane may be removed, and the components of the next two closest modules are joined as if said next closest modules were adjacent, thus forming a structure containing half as many modules substantially twice as large as before. For example, FIG. 23 is an end view of a sixteen module structure approximating a surface of revolution. Eight identical (four left hand, four right hand) components in modules left and right of every fourth limit plane are identified by shading. The remaining eight identical components (for a total of sixteen) are identified by the numeral 2. The axis of revolution 4 is seen end on as the point at center bottom of the structure. If each of the shaded components (pairs of components in pairs of modules each left and right of every fourth limit plane) are removed as shown in FIG. 24, a structure is formed containing half as many modules, each substantially twice as large as before.

Although the axis of rotation of previously illustrated structures are shown as being horizontal, other structures having vertical axes are easily fabricated by splitting the horizontal-axis-structures into two halves along a plane perpendicular to the axis, turning one of these halves to place that plane on the ground, and adding components to complete 360° around the axis. Toroid-like structures may be erected utilizing alternating mirror-image modules similar to the vault type discussed earlier disposed to lie between imaginary planes intersecting in a common vertical axis centered in the "hole" of the toroid.

Compound structures may be formed from modules whose elements lying in the limit planes approximate the same curve but in which some of the limit planes are parallel and some intersect in common axes of rotation. For example, a dome structure such as seen in side elevation in FIG. 6 may be separated along the vertical plane passing through axis of rotation 38, the ends may be spread apart and the intervening space filled with a barrel vault structure, of whatever length desired, such as shown in FIG. 3.

Although the extreme limit planes of the dome structure of FIGS. 4, 5 and 6 are shown as lying 180° from each other, and thus concurrent, so that the structure may rest flat upon level ground, or a poured slab, or any other plane surface, it will be apparent that the structures may be formed with the extreme limit planes angularly displaced less than 180° or more than 180°, up to 360° in which instance the planes are again concurrent. For example, an open shell structure, useful as an acoustical band shell or chorus shell, or the like, may be formed by spacing the extreme limiting planes apart by between about 75° to 105° or so. Such a structure is made rigid and thus determinate by fixing the position of its two extreme limit planes, with the parts of components toughing said planes constrained from moving outside the planes. Or, for example, an open shelter such as a picnic pavilion or the like may be formed by having both limiting planes other than parallel with the ground, such as 30° on either side of the vertical plan passing through the axis of rotation. A very good band shell can be made by using only components 19A and 20A of FIGS. 4A, 5A and 6A, with the remaining components eliminated. To make the structure determinate, additional constraints must be added to components 19A and 20A to replace those lost when the other components of the structure are eliminated. These constraints may be in the form of tensioning cables suitably connected between the joints of the structure.

In some instances, for economy reasons or otherwise, it may be desired to have a structure of the geometry generally as described in which folding is not necessary. Such a structure may be built with rigid joints, but otherwise corresponding to the foldable structures in all other respects, particularly in the respect that all joints between the components or elements of the modules herein described must be treated mathematically as flexible joints in defining the determinate structure, even if they exist only as rigid joints in the physical structure.

FIG. 25 illustrates one form of an universal-joint-type assembly which may be used to connect six struts according to this invention. The joint is composed of an assembly of two basic pinning units, indicated generally at 87 and 88. As best seen in FIG. 26, an exploded view, pinning unit 87 comprises a socket 89 adapted to receive the end of a strut and a pair of spaced apart rings 90 and 91 which are concentric and of equal size about an axis perpendicular to the axis of socket 89. The inside diameters of socket 89 and rings 90 and 91 are preferably the same. Socket 89 may be internally threaded to receive the externally threaded end of a strut. Pinning unit 88 comprises one pair of spaced apart, concentric, equal sized rings 92 and 93 about one axis and a similar pair of rings 94 and 95 disposed about an axis perpendicular to that of the first pair of rings. Rings 90 and 91, 92 and 93 and 94 and 95 are of equal width and are equally spaced apart such that the pinning units may be fitted together by meshing and held by a common capped pin (96 or 97) while still permitting relative rotation between the assembled units, as seen in FIG. 25.

It will be seen that assembled pinning units 87 and 88 provide two perpendicular axes of rotation for each strut. The third perpendicular axis is provided by sockets 89 which hold the struts in the joint, but allow them to rotate about their own axes.

As an example of the use of this form of joint, joint 44A of FIGS. 2A and 5A (Ref. FIG. 21) could be formed from this type of assembly. The long axis of the assembly corresponding to the long pin 27 running through the center of the assembly would be oriented perpendicular to the imaginary plane containing struts 28A and 32A of FIGS. 2A and 5A. Since struts 28A and 32A of the example are constrained by the nature of the structure always to lie in a common plane, they need only rotate with respect to each other about one axis perpendicular to their common plane. This corresponds to the axis of pin 97 of the joint assembly. Therefore if so desired, two middle pinning units 88 of the joint assembly may be eliminated, with the two middle pinning units 87 with sockets accepting strut 28A and strut 32A being pinned directly by pin 97. Where one strut is connected along the length of another, such as at joint 45A of FIG. 2A or 5A, the joint assembly would consist of pinning unit 87 held by pin 96 to unit 88. The end connected strut fits into socket 89 while the other strut passes through the rings of pinning unit 88, functioning the same as pin 97. Two restraining collars may be fastened around the strut to function the same as the caps of pin 97. Where many struts come together at a pole, such as at joint 65A of FIG. 6A, pin 97 is replaced by a ring extending through the rings 92 and 93 of a plurality of pinning units 88. Any arbitrary number of struts may be joined together simply by changing the length of pin 97, but it should be emphasized that the invention is not dependent upon this or any other hinge means. For example, joints similar to those described by Cook, U.S. Pat. No. 3,148,539 provide one alternative method of connecting struts according to the invention.

Although the hinge joint of FIGS. 25 and 26 is one form of connecting means which may be used in constructing structures according to this invention, the joints used need not be of specific type in the sense of requiring structural connections not freely available. Numerous references are made to various components being "hinged", but no particular type of hinge is required.

For a linear connection along the common edges of two adjoining panels, permitting one degree of freedom, the joints may be a piano hinge, or a flexible strip, such as tape, or the like. For a point connection from strut to strut, strut to panel, or panel to panel at a point, permitting 3° of freedom the flexible connection may be a ball joint such as on a camera tripod, a gyroscope type gimbal, a universal joint with added third perpendicular axis, short flexible tubing and spherical hinges as exemplified by Cook U.S. Pat. No. 3,148,539 such as used in model building, and the like.

None of these joints has the ideal properties of a perfect point or line connection (no friction, 360° travel, no eccentricity, etc.). Gimbals are expensive and have limited travel if more than three members are joined at one point. Concentric balls have limited travel. Flexible materials produce small eccentricities, as do universal joints, which allow excellent travel for all members of a multi-strut joint at the expense of displacing their perpendicular rotational axes small distances from a point of common intersection (struts meet eccentrically at the joint). Nevertheless, any of these joints may be used successfully in a structure according to this invention so long as their total number (and thus the total number of constraints) is chosen on the assumption that they behave as ideal joints. The most important property is that they ideally transmit no moment about one (liner connection) or 3 perpendicular (point connection) axes, because this property determines the total number of joints necessary to make the module structurally determinate.

Where full folding capability of the structure is not desired, less expensive joints exhibiting properties farther from the ideal than more expensive joints may be used. However, as long as they transfer tensile and compressive forces without transferring appreciable moments, they may be used according to this invention in the design of structures which approximate cylindrical and revolved surfaces with the advantages of determinate design.

The practice of making structures determinate with moment-free joints only is well known in structural design. For example, trusses are ideally treated as an assembly of struts connected by moment-free joints. But this invention involves building a module between two planes which is determinate when joints are not only moment-free, but joints at the planes can slide in the planes. When a plurality of these modules are connected together as if they were reflections of one module between two mirrors placed at the limit planes, the structure so formed is determinate and foldable.

It is apparent that many modifications and variations of this invention as hereinbefore set forth may be made without departing from the spirit and scope thereof. The specific embodiments described are given by way of example only. The invention is limited only by the terms of the appended claims.

The embodiments of the invention in which an exclusive property or privilege is claimed are defined as follows:

1. A modular building structure of configuration approximating the surface generated by regular, uniform movement of a plane curve, said structure comprised of:

(A) a plurality of interconnected basic structural modules of alternately repeating right and left handed (mirror image) form, each right handed module being adjacent to a left handed module and adjacent modules interconnected side to side along a boundary interface;

(B) a series of limit planes defining the two furthermost module sides and the boundary interface between adjacent modules, each plane equally displaced from the next;

(C) each module being comprised of a plurality of interconnected hinged rigid structural components, each component being hingedly connected to at least two other components, parts of said components lying in said limit planes;

(D) those parts of the module components lying in one limit plane being serially connected to form one side of a module, making an approximation of a plane curve determining the contour of the building structure; those parts on the oposite side of the same module lying in the next adjacent limit plane being serially connected to form the opposite side of the module, making a different approximation of the same plane curve;

(E) other parts of said components occupying the three dimensional space between two adjacent limit planes extending between and interconnecting said parts of the components which form said two different approximations of plane curves;

(F) the parts of said components lying in said limit planes being constrained from moving outside their respective planes by pairs of said module components connected at and symmetrical left and right about said limit planes, components of each right hand module paired with like components of each left hand module;

(G) the parts of said components lying at the ends of said modules defined by the end tips of said plane curve, being connected to fixed supports constraining said parts to fixed points;

(H) a single module being made rigid and determinate according to the rules of structural analysis, with the constraints to be contributed by its mirror image adjacent modules replaced by the condition that neither side of the single module is permitted to deflect out of a plane;

(I) the structure composed of a plurality of said modules being made rigid and determinate by the action of each module constraining the sides of adjacent modules not to deflect out of said limit planes, by said two furthermost module sides being connected to fixed planar supports, and by said module ends being connected at fixed support points.

2. A building structure according to claim 1 further characterized in that said equally displaced planes intersect in a common axis and each region of the structure near relative minima, with respect to that axis, of the curve which generates the surface approximated by the structure, is assigned a distance from the axis within which the components of the two modules adjacent every fourth limit plane may be removed, and the components of the next two modules closest said planes may be joined as if said closest modules were adjacent, thereby forming a structure containing half as many modules, said modules being substantially twice as large as before.

3. A method for the fabrication of a modular building structure according to claim 1 which comprises:

(A) assemblying a plurality of hinged rigid structural components into a plurality of interconnected basic structurally similar modules of alternating repeating right and left handed (mirror image) form, each right haned module being adjacent to a left handed module;

(B) establishing a series of equally displaced limit planes separating adjacent modules;

(C) serially connecting joining parts of said components lying in said planes to approximate a curve;

(D) joining all of said components so that any moment-transmitting capability of the joints is not considered in calculating the number of constraints required to make each module determinate according to the rules of structural analysis;

(E) constraining any parts of said components forming ends of said modules lying between said limit planes to lie at fixed points in space; and (F) joining additional components to those connected in the planes to complete the total of moment-free joints required for a determinate structure, thereby constraining parts of said components lying in the planes from moving outside of the planes, as they would be constrained for a single module erected with sliding attachment to two real planar surfaces at the limit planes.

4. A folding modular building structure of configuration approximating the surface generated by regular, uniform movement of a plane curve, said structure comprised of:

(A) a plurality of interconnected basic structural modules of alternately repeating right and left handed (mirror image) form, each right handed module being adjacent to a left handed module and adjacent modules interconnected side to side along a boundary interface;

(B) a series of limit planes defining the two furthermost module sides and the boundary interface between adjacent modules, each plane equally displaced from the next, and said planes retaining equal displacement while approaching each other when the structure is folded;

(C) each module being comprised of a plurality of interconnected hinged rigid structural components, each component being hingedly connected to at least two other components such that any two adjoining components, if removed from the remainder of the structure while retaining their mutual connection, are free to pivot with respect to each other, parts of said components lying in said limit planes;

(D) those parts of the module components lying in one limit plane being serially connected to form one side of a module, making an approximation of a plane curve determining the contour of the building structure; those parts on the opposite side of the same module lying in the next adjacent limit plane being serially connected to form the opposite side of the module, making a different approximation of the same plane curve;

(E) other parts of said components occupying the three dimensional space between two adjacent limit planes extending between and interconnecting said parts of the components which form said two different approximations of plane curves;

(F) the parts of said components lying in said limit planes being constrained from moving outside of their respective planes by pairs of said module components connected at and symmetrical left and right about said limit planes, components of each right hand module paired with like components of each left hand module;

(G) the parts of said components lying at the ends of said modules defined by the end tips of said plane curve being connected to fixed supports constraining said parts to fixed points;

(H) a single module being made rigid and determinate according to the rules of structural analysis, with the constraints to be contributed by its mirror image adjacent modules replaced by the condition that neither side of the single module is permitted to deflect out of a plane;

(I) the structure composed of a plurality of said modules being made rigid and determinate by the action of each module constraining the sides of adjacent modules not to deflect out of said limit planes, by said two furthermost module sides being connected to fixed planar supports, and by said module ends being connected at fixed support points.

5. A building according to claim 4 further characterized in that:

(A) said rigid structural components are composed of planar elements (panels), permitting point connection (panel to panel at one point) and linear connection (panel to panel along a line common to both panels);

(B) as to planar elements having edges and point connections at the ends of those edges lying in one of said limit planes, said point connections allowing said adjoining components to pivot with respect to each other about one axis perpendicular to the plane (one degree of freedom);

(C) as to other point connections between planar elements, said point connections allowing two adjoining panels to pivot with respect to each other about three mutually perpendicular axes (three degrees of freedom); and (D) said linear connections allowing two adjoining panels to pivot about one axis corresponding to the vertex of the dihedral angle they form (one degree of freedom).

6. A building structure according to claim 4 further characterized in that:

(A) said rigid structural components are composed of linear elements (struts) and planar elements (panels) permitting two types of connection - point connection (strut to strut, strut to panel, and panel to panel at one point) and linear connection (panel to panel along a line common to both panels);

(B) as to linear elements lying in and having end to end connections in one of said limit planes and planar elements having edges and point connections at the ends of those edges lying in one of said limit planes, said point connections allowing said adjacent components to pivot with respect to each other about one axis perpendicular to the plane (one degree of freedom);

(C) as to other point connections between elements said point connections allowing two adjoining components to pivot with respect to each other about three mutually perpendicular axes (three degrees of freedom); and (D) said linear connections allowing two adjoining panels to pivot about one axis corresponding to the vertex of the dihedral angle they form (one degree of freedom).

7. A building according to claim 4 further characterized in that:

(A) said rigid structural components are composed of linear elements (struts) permitting point connection (strut to strut);

(B) as to linear elements lying in and having end to end connections in one of said limit planes, said point connections allowing said adjoining components to pivot with respect to each other about one axis perpendicular to the plane (one degree of freedom); and (C) as to all other point connections between linear elements, said point connections allowing two adjoining components to pivot with respect to each other about three mutually perpendicular axes (three degrees of freedom).

8. a building structure according to claim 7 further characterized in that the spaces defined by the struts of said rigid structural components are spanned by sheet material supported by said struts.

9. A building structure according to claim 4 further characterized in that said planes defining limits of said modules are intersecting planes displaced by equal angles, said planes intersecting in a common generally horizontal axis of revolution whereby the building structure is dome-shaped, approximating a surface of revolution.

10. A building structure according to claim 9 further characterized in that corresponding rigid structural components of each structural module on opposite sides of the centerline of the building are triangles of the same size and the base of each triangle is of length greater than the sides, whereby said dome-shaped structure is symmetrical and generally hemispherical.

11. A building structure according to claim 4 further characterized in that said planes defining limits of said modules are spaced apart vertical planes.

12. A building structure according to claim 11 further characterized in that said spaced apart vertical planes are intersecting planes displaced by equal angles, said planes intersecting in a vertical axis of revolution whereby the building structure is generally toroidal, approximating a surface of revolution.

13. A building structure according to claim 11 further characterized in that said spaced apart vertical planes are parallel, whereby said building is generally vaulted, approximating a cylindrical surface.

14. A building structure according to claim 13 further characterized in that corresponding rigid structural components of each structural module on opposite sides of the longitudinal axis of the building are triangles of the same size and the base of each triangle is of length greater than the sides, whereby said structure is symmetrical about its longitudinal axis and generally semi-cylindrical approximating a right cylindrical surface.

15. A building structure according to claim 13 further characterized in that some of said rigid structural components of each structural module are of unequal size and the sides and bases thereof are of unequal length whereby said vaulted structure is unsymmetrical about its longitudinal axis.

* * * * *

UNITED STATES PATENT AND TRADEMARK OFFICE

CERTIFICATE OF CORRECTION

PATENT NO. : 4,074,477

DATED : February 21, 1978

INVENTOR(S) : John F. Runyon

It is certified that error appears in the above-identified patent and that said Letters Patent are hereby corrected as shown below:

Column 3, line 11, after "is", insert --further--.

Column 3, line 25, after "32", insert --two--.

Column 3, line 58, "given" should be --giving--.

Column 4, line 8, "decrease" should be --decreases--.

Column 6, line 5, "decrease" should be --decreases--.

Column 6, line 14, "an" should be --and--.

Column 6, line 20, "shiped" should be --shipped--.

Column 6, line 58, "th" should be --the--.

Column 6, line 60, "sseen" should be --seen--.

Column 7, line 17, "soley" should be --solely--.

Column 7, line 46, "piont" should be --point--.

Column 8, line 14, ";" should be --,--.

Column 8, line 19, "connection" should be --connecting--.

Column 8, line 24, ";" should be --:--.

Column 8, line 62, "point" should be --joint--.

Column 9, line 65, "th" (2nd occurrence) should be --the--.

UNITED STATES PATENT AND TRADEMARK OFFICE

CERTIFICATE OF CORRECTION

PATENT NO. : 4,074,477

DATED : February 21, 1978

INVENTOR(S) : John F. Runyon

It is certified that error appears in the above-identified patent and that said Letters Patent are hereby corrected as shown below:

Column 11, line 5, "toughing" should be --touching--.

Column 11, line 9, "plan" should be --plane--.

Column 11, line 58, "27" should be --97--.

Column 12, line 55, "liner" should be --linear--.

Column 13, line 10, after "two", insert --plane--.

Signed and Sealed this

Ninth Day of May 1978

[SEAL]

Attest:

RUTH C. MASON
Attesting Officer

LUTRELLE F. PARKER
Acting Commissioner of Patents and Trademarks